US006550190B2

(12) United States Patent
Ruiz et al.

(10) Patent No.: US 6,550,190 B2
(45) Date of Patent: Apr. 22, 2003

(54) DRAINAGE SYSTEM FOR WATERPROOFING A FOUNDATION

(75) Inventors: Richard D. Ruiz, Des Peres, MO (US); Thomas E. Jernigan, Winchester, KY (US)

(73) Assignee: Fas-Flo, Inc., St. Louis, MO (US)

( * ) Notice: Subject to any disclaimer, the term of this patent is extended or adjusted under 35 U.S.C. 154(b) by 33 days.

(21) Appl. No.: 09/840,478

(22) Filed: Apr. 23, 2001

(65) Prior Publication Data

US 2002/0152696 A1 Oct. 24, 2002

(51) Int. Cl.[7] ..... E02D 31/02
(52) U.S. Cl. ..... 52/169.5; 52/302.1
(58) Field of Search ..... 52/302.1, 169.5

(56) References Cited

U.S. PATENT DOCUMENTS

| | | | | | |
|---|---|---|---|---|---|
| 3,283,460 | A | | 11/1966 | Patrick | |
| 3,850,193 | A | | 11/1974 | Guzzo | |
| 3,852,925 | A | * | 12/1974 | Gazzo | 52/169 |
| 3,946,762 | A | | 3/1976 | Green | |
| 4,185,429 | A | | 1/1980 | Mendola | |
| 4,265,064 | A | | 5/1981 | Parezo | |
| 4,381,630 | A | | 5/1983 | Koester | |
| 4,538,386 | A | | 9/1985 | DiCello | |
| 4,572,700 | A | | 2/1986 | Mantarro et al. | |
| 4,590,722 | A | | 5/1986 | Bevilacqua | |
| 4,612,742 | A | * | 9/1986 | Bevilacqua | 52/169.5 |
| 4,745,716 | A | * | 5/1988 | Kuypers | 405/43 |
| 4,837,991 | A | | 6/1989 | Shaw | |
| 4,840,515 | A | | 6/1989 | Freese | |
| 4,869,032 | A | * | 9/1989 | Geske | 405/43 |
| 4,907,385 | A | * | 3/1990 | Biodrowski | 405/45 |
| 4,930,272 | A | * | 6/1990 | Bevilacqua | 405/36 |
| 5,466,092 | A | | 11/1995 | Semenza et al. | |
| 5,495,696 | A | * | 3/1996 | Repka | 405/229 |
| 5,501,044 | A | * | 3/1996 | Janesky | 404/4 |
| 5,694,723 | A | | 12/1997 | Parker | |
| 5,784,838 | A | | 7/1998 | Phillips | |
| 5,794,388 | A | | 8/1998 | Jackman | |

* cited by examiner

*Primary Examiner*—Carl D. Friedman
*Assistant Examiner*—Basil Katcheves
(74) *Attorney, Agent, or Firm*—Greensfelder, Hemker & Gale, P.C.

(57) ABSTRACT

A method for draining accumulated moisture from the juncture between a wall and footing of a foundation is provided. The method comprises excavating a channel into the floor adjacent to the wall into which a drainage conduit is placed. The drainage conduit is wrapped with a wicking fabric to draw moisture into and along the drainage conduit for conveying to a moisture collection reservoir.

16 Claims, 4 Drawing Sheets

DRAINAGE SYSTEM FOR WATERPROOFING A FOUNDATION

BACKGROUND OF THE INVENTION

The invention addresses problems relating to the accumulation of water at the juncture of a wall and footing of a foundation, especially in basements. This area of the foundation is susceptible to the accumulation of water on top of the footing coming in through the wall, due to external leakage resulting from hydrostatic pressure generated by excess moisture in the soil, and also from water rising up from underneath the foundation. The pressure from water pushing in on the outside of the foundation wall can be quite substantial, and contributes significantly to foundation leakage. It is therefore important to alleviate hydrostatic pressure against the foundation by draining off accumulated water that may be sitting on top of the footing at its juncture with the wall.

Another problem caused by accumulated water on top of the footing is mildew, which creates the musty odor commonly present in basements. Even though a substantial amount of standing water may be removed by prior art waterproofing methods that utilize a drainage conduit, residual moisture will still cause mildew problems. While a typical drainage conduit can effectively divert a substantial amount of water away from the area, it simply cannot by itself move water that accumulates in low areas. It is that remaining source of water that causes the mildew problems.

It would therefore be desirable to provide a method for removing water accumulating at the juncture of a foundation and wall to alleviate the hydrostatic pressure placed on the foundation. Further, it would be beneficial to provide a means for removing residual moisture from that area to minimize the creation of mildew.

SUMMARY OF THE INVENTION

By means of the instant invention there is provided a method and apparatus for conveying and draining off accumulated moisture from the top of the footing of a foundation. The invention also helps to intercept water rising up from underneath the foundation. The method comprises providing a channel beneath the floor and along the footing at the area comprising the juncture of the wall with the foundation, and placing a drainage conduit in the channel to convey water to a moisture collection reservoir away from the foundation. The drainage conduit comprises a tile having a wicking fabric wrapped around it for drawing and conveying standing moisture into and along its length for transfer to a moisture collection reservoir.

The tile of the drainage conduit preferably has a rectangular cross-sectional shape and has a low profile to provide an economy of space within the channel. A series of apertures are disposed in the sides of the tile to permit entry of water therein. The tile may be open along its bottom so as to include entry of low-lying residual moisture directly into the bottom of the tile. Likewise, the apertures are preferably configured as semi-circles, having a lower area that opens into the bottom of the tile. The wicking fabric wrapped around the tile helps to draw off residual moisture from the foundation-wall juncture as well as to intercept water rising from the area in the ground next to the footing. The fabric is constructed such that moisture travels through it by capillary action. Water is both drawn into the drainage conduit and also travels along its length through the fabric toward the area of the moisture collection reservoir, effectively making the entire outside perimeter of the drainage conduit a vehicle for conveying moisture. The drainage conduit is placed along the top of the footing adjacent the wall where the majority of moisture will accumulate. To intercept moisture as it rises from the ground, an edge of the drainage conduit is placed on the footing so as to extend over the interior shoulder of the footing. The channel and drainage conduit are extended along the footing as far as necessary to drain the desired section of foundation. A moisture collection reservoir is provided at the end of the channel and drainage conduit for removal of water from the area of the foundation.

DESCRIPTION OF THE INVENTION

Figure 1:
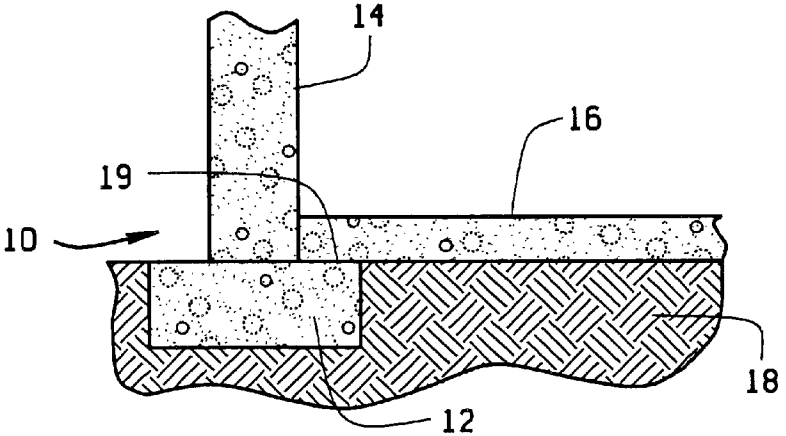
FIG. 1 is a cross-sectional view in side elevation of the footing, wall and floor of a foundation.

The area of concern for which the invention is employed is in a foundation 10, such as for a basement, along the top of the footing 12 at its juncture with the wall 14 as shown in FIG. 1. Typically, a floor 16 is laid on top of the footing and abuts the wall. Dirt and/or gravel 18 generally lie directly adjacent the footing and underneath the floor within the foundation. It is at juncture 19 between the wall and footing, which is occasionally referred to as the cove joint, that water and moisture can accumulate, coming in from cracks in the wall and foundation, and can also rise up from the earth underneath the floor and adjacent the footing.

Figure 2:
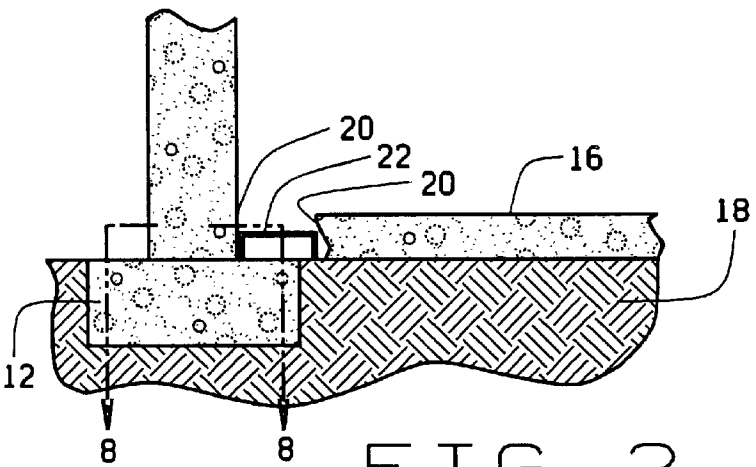
FIG. 2 is a view similar to FIG. 1, with a portion of the floor removed to create a channel to receive the drainage conduit.
Figure 4:
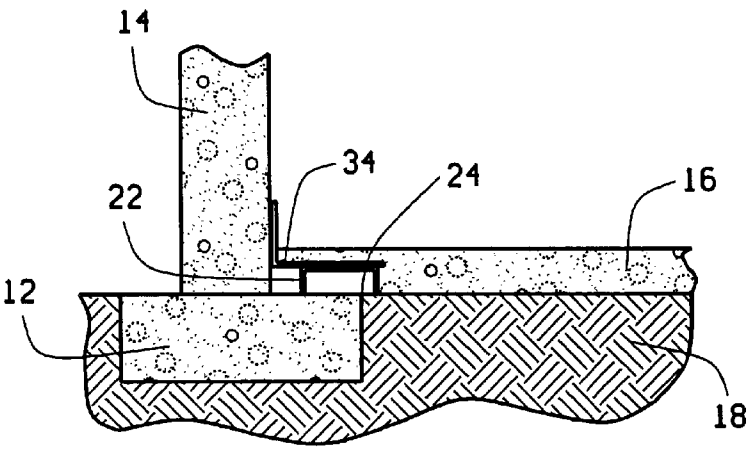
FIG. 4 shows an alternate placement of the drainage conduit over a footing with a wider shelf.

In preparation of laying down the drainage conduit 22 of the instant invention, a channel 20 is excavated in floor 16 from wall 14 out to a width sufficient to accommodate the conduit, preferably about six inches or so, and to a depth sufficient to reach to footer 12 as shown in FIG. 2. Preferably, the channel should be wide enough to extend beyond the interior edge of the footing. The channel may extend the full perimeter of the foundation, or may just extend along one wall or a portion thereof, depending upon the particular waterproofing requirements for the foundation. The channel and drainage conduit serve to intercept the rising water table and divert away water before it applies hydrostatic pressure against the foundation. Drainage conduit 22 is placed in the channel on top of the footing and butted up against the wall 14 as shown in FIG. 2. Typically, a footer in a basement foundation is 16 inches wide, and the wall is placed on the center of the footing. The wall is generally 8 inches wide which results in footer shoulders of approximately 4 inches on either side of the wall. Occasionally, the footer shoulder may be greater or less than 4 inches. In most cases, however, the conduit will hang over the edge of the footing. In situations where the footing is wider than the drainage conduit, it is advantageous to place the conduit such that an edge overhangs the internal edge 24 of the footer, as shown in FIG. 4, to capture water as it rises from the ground inside the foundation.

Figure 5:
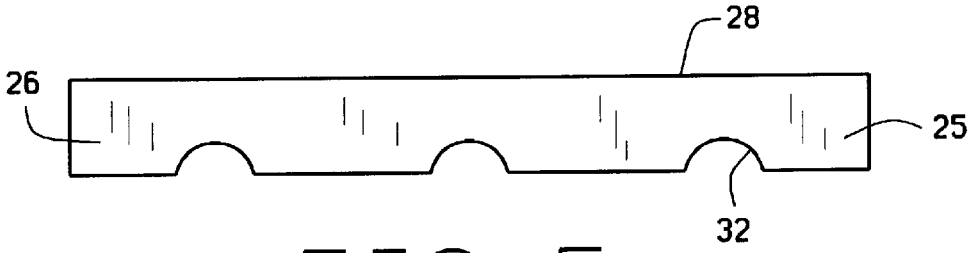
FIG. 5 is a view in side elevation of the drainage conduit tile.

Tile 25 is preferably comprised of hard plastic material such as PVC or ABS, and has a rectangular, low-profile shape as shown in FIG. 5. It has lateral sides 26 and a top surface 28 forming an elongated conduit. Tile 25 is preferably formed without a bottom surface to maximize its water-receiving capability. Preferred dimensions for the tile are 1½ inches in height and 5 inches in width, although other dimensions may similarly be appropriate. A series of apertures 32 are formed into the bottom edge of each of lateral sides 26 and may be disposed about every 2 inches or so along the length of the tile. The apertures are preferably configured to have a semi-circular shape, such that the apertures do not form a bottom edge, but rather, open directly into the lower edge of the lateral sides 26 as shown in FIG. 5. The advantage provided by this configuration is that all levels of moisture can access the tile. An aperture that is otherwise disposed above the bottom edge of the wall of a tile can only drain water to the lowest level of the edge of the aperture, which will leave a residual level of moisture below the height of the bottom edge of the aperture.

Figure 6:
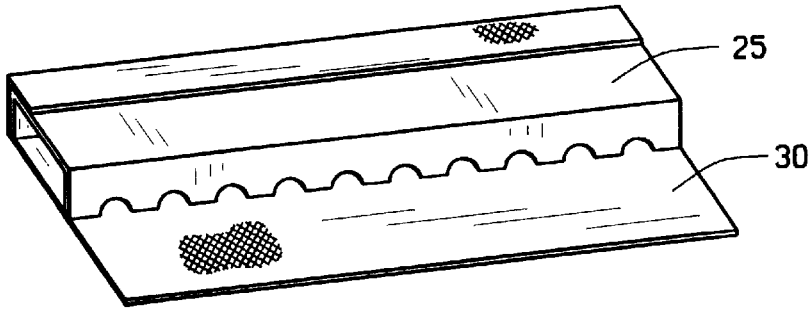
FIG. 6 is a perspective view of the wicking fabric being wrapped around the tile.
Figure 7:
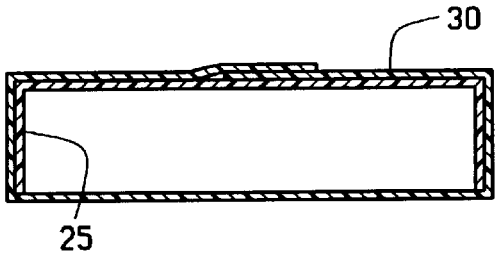
FIG. 7 is a cross sectional view of the drainage conduit with the wicking fabric wrapped around the tile.

To further enhance the ability of the drainage conduit to divert accumulated moisture, a wicking fabric 30 is wrapped around the tile as shown in FIGS. 6 and 7. The wicking fabric should preferably remain as a continuous sheet along the tile with no gaps along its length in order for the capillary action movement of water to be maintained and for moisture to be effectively conveyed. In most instances, however, the layout of the drainage conduit will extend for a considerable length or will have a 90° turn around a corner such that a continuous sheet of wicking fabric is impractical. In such cases, overlapping of the wicking fabric is acceptable so long as there are no gaps in the contiguous contact of fabric to disrupt the capillary flow of moisture within the fabric. Comers of the fabric may be folded or mitred. The wicking fabric draws residual moisture lying on top of the footing that can not normally enter a drainage conduit, either because it is trapped in a low-lying area or because it is not of a sufficient level for free-flowing movement through the drainage conduit. Moisture will come into contact with, and flow through, the fabric. Moisture can therefore enter the drainage conduit 22 from any direction. Furthermore, moisture will also travel alongside the entire exterior perimeter of the drainage conduit through the wicking fabric.

Figure 3:
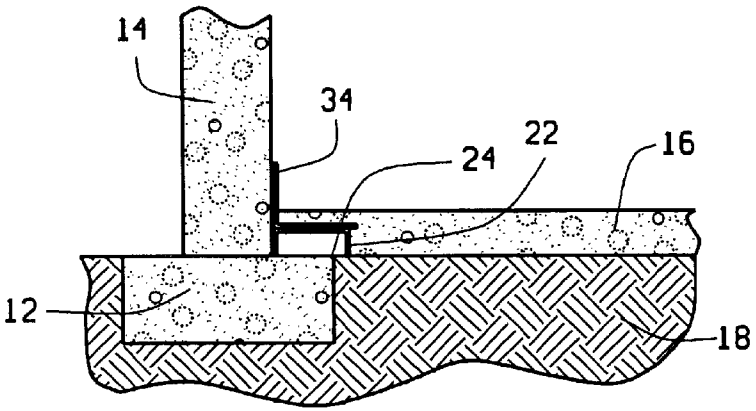
FIG. 3 is a view similar to FIG. 2, showing the replacement of the floor over the drainage conduit and channel.

In preparing drainage conduit 22, a length of wicking fabric 30 is placed down within channel 20, ensuring that no gaps are present along its length. Because the fabric will be wrapped around the tile, the fabric should have a sufficient width, preferably approximately 15 inches, such that it will completely encircle the tile with its edges overlapping. The tile is then placed down in channel 20 over the fabric 30, being positioned directly on top of footer 12 and in near proximity to wall 14. Once the tile is laid down, the wicking fabric is wrapped around it and secured by gluing or stapling to the top of the tile. Additional lengths of wicking fabric may be overlapped as necessary depending on the length and direction of the layout of the drainage conduit. To draw water rising from the dirt 18 beneath the floor and adjacent to the interior surface of the footer, it is desirable to place the prepared drainage conduit 22 in the channel such that its edge overlaps the edge of the top of the footer as shown in FIGS. 3 and 4. In most situations, the five inch wide tile 25 will extend one inch past edge 24 of the four inch wide footing shelf 12. If the footer shelf is wider than four inches, however, tile 25 should preferably be shifted over from wall 14 to ensure that conduit 22 overhangs past footer edge 24 to facilitate the capture of moisture rising adjacently from footer 12 as shown in FIG. 4.

The weaving of the fabric facilitates capillary attraction which provides a path of least resistance for accumulated water to follow as well as acting as a drawing agent to pull water into the system depending on the amount of water and contact with the fabric. If there is enough water to create a differential hydrostatic pressure, the water will flow from the area of higher resistance, such as in the surrounding soil or on the concrete, into the area of low resistance, which is the drain tile. If only moderate amounts of water are in contact with the system the fabric will wick, or pull the water out of the soil into the fabric. Again, depending on the amount of water available, the liquid will flow either through the drain tile or, through capillary action, be channeled through the fabric to the collection sump for disposal.

The wicking fabric used in connection with this invention may be of any type capable of conveying moisture as previously described. Particularly useful is a fabric manufactured by TC Mirafi, and sold under the trademark Mirafi® Filterweave Woven Geotextiles. This fabric has hydraulic properties falling within the following ranges:

Apparent Opening Size: 0.212–0.600 mm (ASTM D 4751)

Pemittivity: 0.28–1.50 $sec^{-1}$ (ASTM D 4491)

Percent Open Area: 4–20% (COE-02215–86)

Flow Rate: 733–5907 $1/min/M^2$ (ASTM D 4491)

More preferably, Mirafi® Filterweave Woven Geotextile series FW-401 is used, which has the following characteristics:

Apparent Opening Size: 0.425 mm (ASTM D 4751)

Pemittivity: 2.14 $sec^{-1}$ (ASTM D 4491)

Percent Open Area: 20% (COE-02215–86)

Flow Rate: 5907 $l/min/m^2$ (ASTM D 4491)

Figure 8:
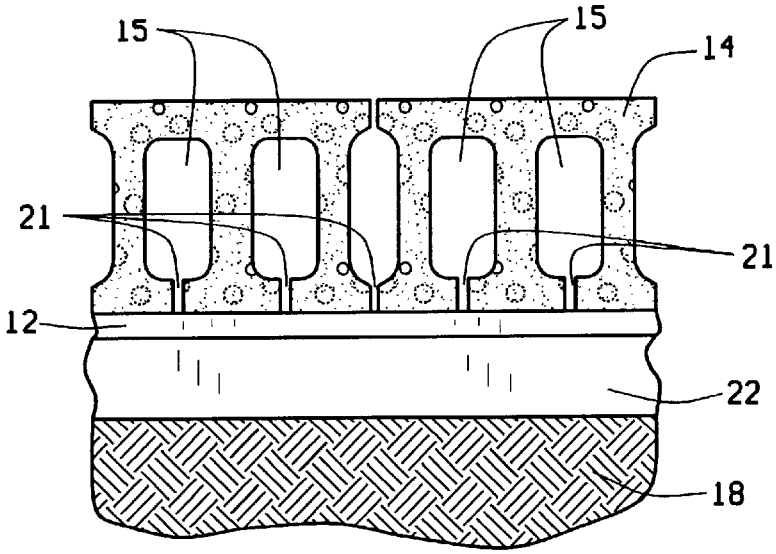
FIG. 8 is a top plan, cross-sectional view taken along lines 8—8 in FIG. 2.
Figure 9:
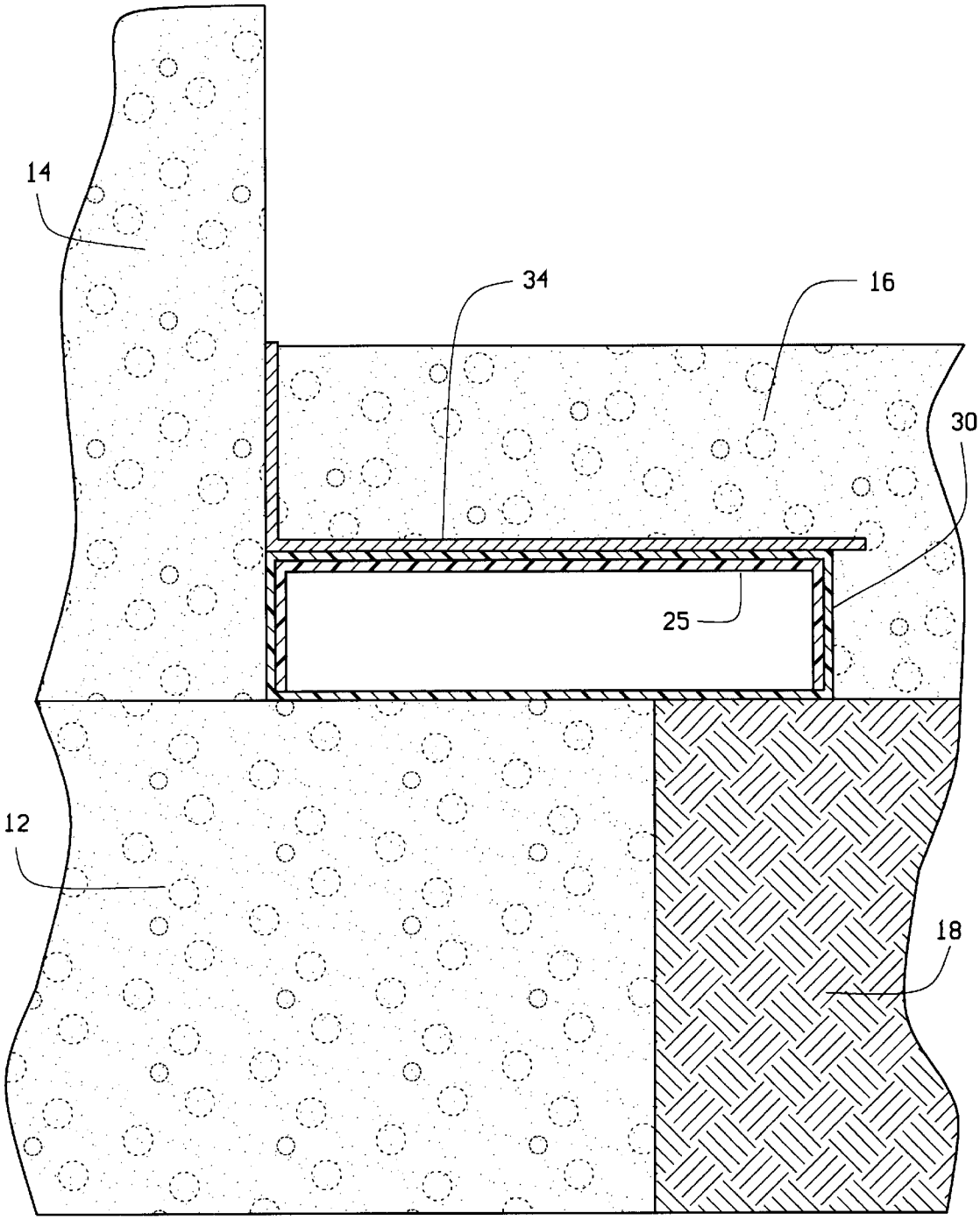
FIG. 9 is a cross sectional view of the installed drainage conduit with the floor replaced.

After the drainage conduit is laid in position, the channel is re-cemented to an even level with the rest of the floor. The previously excavated area adjacent the footer may also be filed in with gravel for support. A spacing member 34 is placed on top of drainage conduit 22 for moisture to more easily filter down to the channel as shown in FIG. 3. Spacing member 34 comprises a drainage board, which is well known to those skilled in the art, comprising a PVC or ABS sheet having a plurality of downwardly depending projections. The interstitial area between the downward projections below the sheet facilitate the movement of moisture to the drainage conduit. To allow moisture seeping down from the interior side of wall to also drain into channel 20, a gap may be placed between the edge of the floor and the wall as shown in FIG. 9 as is well known to those having skill in the art. Frequently, a wall may be comprised of concrete blocks having hollow cores in which water can accumulate. FIG. 8 shows a section of wall 14 having hollow cores 15. Drain holes 21 are drilled into the bottom of each of the hollow cores to allow moisture to drain out on to footing 12 where it can access drainage conduit 22.

Figure 10:
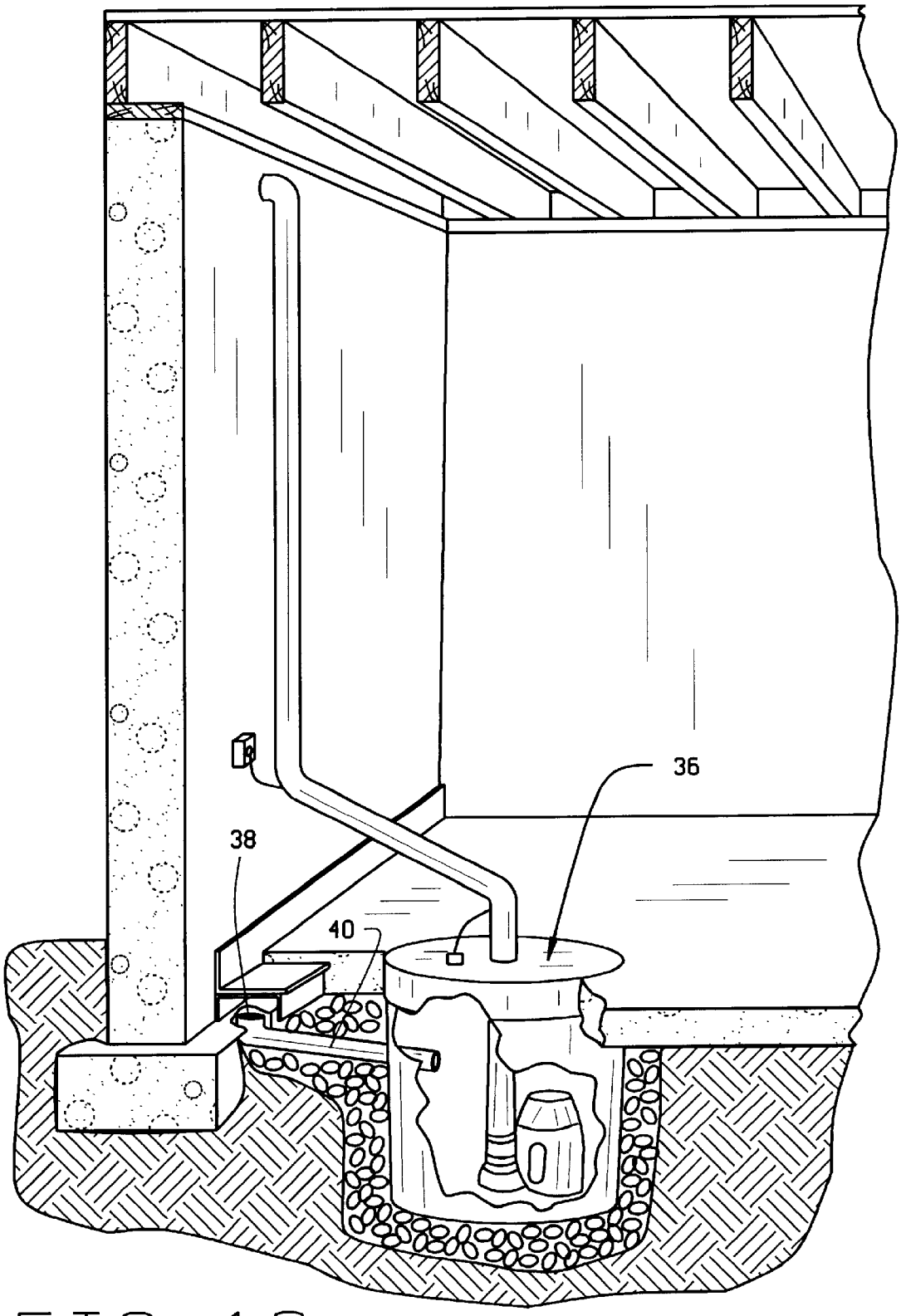
FIG. 10 is a view, partially broken away, of the drainage collection reservoir.

The drainage conduit 22 drains off the accumulated moisture to a collection reservoir or sump pit 36 which can be of any type known to those skilled in the art. The terminal end 38 of conduit 22 may be provided with a drainage pipe 40 that dumps off moisture to collection reservoir 36 as shown in FIG. 10. A portion of the footing may be removed to accommodate drainage pipe 40 at the point where it communicates with the bottom of drainage conduit 22. The collection sump placement is governed by the physical logistics of the particular job site application to take advantage of natural water flow, gravity and disposal considerations. A pump may be used in connection with the collection reservoir to provide a drawing force for pulling the conveyed moisture to the collection reservoir.

Although the present invention contemplates assembly of the drainage conduit at the job site, it may be advantageous to produce pre-assembled drainage conduits such that the tiles are fabricated with wicking fabric form fitted around its exterior in the manner above described to increase the efficiency of the installation process.

Various changes and modifications may be made within this invention as will be apparent to those skilled in the art. Such changes and modifications are within the scope and teaching of this invention as defined in the claims appended hereto.

What is claimed is:

1. A method for draining accumulated moisture from an area comprising an interior juncture between a wall and a footing of a foundation, said interior juncture lying beneath a floor within said foundation, said method comprising:

excavating said floor adjacent to said wall to provide a channel on top of said footing and along said interior juncture, placing a drainage conduit in said channel such that said drainage conduit directs a flow of water laterally along said channel and substantially parallel with said wall, said drainage conduit comprising a tile having a plurality of apertures for receiving moisture therein, and a moisture wicking fabric wrapped around said tile, said wicking fabric having characteristics enabling it to draw and convey moisture, and further providing a moisture collection reservoir in fluid communication with said channel to receive drained moisture, whereby moisture accumulated at said area comprising said interior juncture between said wall and said footing of said foundation is drawn away from said area along said drainage conduit to said moisture collection reservoir.

2. The method according to claim 1 in which said tile is configured to be open along a bottom thereof.

3. The method according to claim 2 in which said apertures are disposed in lower side edges of said tile, each of said apertures defining an opening which extends to said open bottom of said tile.

4. The method according to claim 1 in which a wall being comprised of concrete blocks having a hollow core is provided with a plurality of drain holes to be in communication with said channel to divert accumulated water within said hollow core of said wall to said channel.

5. The method according to claim 1 in which said floor is replaced over said channel after said drainage conduit has been placed therein.

6. The method according to claim 5 in which a gap is provided in said floor adjacent to said wall to allow water seeping along a surface of said wall to drain through said gap into said channel.

7. The method according to claim 5 in which a spacing member is placed between a top of said drainage conduit and below said floor to facilitate a flow of water to said conduit.

8. The method according to claim 1 in which said channel is configured to extend over an interior edge of said footing, and said drainage conduit is placed within said channel such that an edge of said drainage conduit extends over said interior edge of said footing, whereby moisture seeping up in to said foundation from an interior side of said footing is directed into said drainage conduit.

9. A method for intercepting and conveying moisture rising from a ground area adjacent to a footing of a foundation at a side of said footing which is interiorly disposed with respect to a building, in which a wall is positioned on top of said footing, and a floor is positioned adjacent to said wall and over said footing, said method comprising:

excavating said floor adjacent to said wall to provide a channel on top of said footing and along an interior juncture between said wall and said footing, said channel having a width extending beyond an interior edge of said footing, placing a drainage conduit in said channel such that said drainage conduit partially overhangs said interior edge of said footing, disposing said drainage conduit to direct a flow of water laterally along said channel and substantially parallel with said wall, said drainage conduit comprising a tile having a plurality of apertures for receiving moisture therein, and a moisture wicking fabric wrapped around said tile, said wicking fabric having characteristics enabling it to draw and convey moisture, and further providing a moisture collection reservoir in fluid communication with said channel to receive drained moisture, whereby moisture rising from said ground area adjacent to said footing is drawn away from said area along said drainage conduit to said moisture collection reservoir.

10. The method according to claim 9 in which said tile is configured to be open along a bottom thereof.

11. The method according to claim 10 in which said apertures are disposed in lower side edges of said tile, each of said apertures defining an opening which extends to said open bottom of said tile.

12. The method according to claim 9 in which said floor is replaced over said channel after said drainage conduit has been placed therein.

13. The method according to claim 12 in which a spacing member is placed between a top of said drainage conduit and below said floor to facilitate a flow of water to said conduit.

14. A drainage conduit adapted for use along an interior juncture between a wall and a footing of a foundation, said drainage conduit being comprised of a wicking fabric wrapped around a tile, said tile having a rectangular structure with a width of around five inches, said tile being adapted to the lie flat on, and extend along, a top surface of said footer, said tile having a plurality of apertures for receiving moisture therein, said wicking fabric having characteristics enabling it to draw and convey moisture from all areas surrounding said drainage conduit into said tile.

15. The drainage conduit of claim 14 in which said tile is configured to be open along a bottom thereof.

16. The drainage conduit of claim 14 in which said apertures are disposed in lower side edges of said drainage conduit, each of said apertures defining an opening which extends to said open bottom of said conduit.

* * * * *